US005228427A

United States Patent [19]

Gardner, Jr.

[11] Patent Number: 5,228,427

[45] Date of Patent: Jul. 20, 1993

[54] IMPROVED BARREL FOR PAINTBALL GUN

[75] Inventor: William M. Gardner, Jr., Ligonier, Pa.

[73] Assignee: Smart Parts, Inc., Latrobe, Pa.

[21] Appl. No.: 696,203

[22] Filed: May 6, 1991

[51] Int. Cl.[5] ..... F41B 11/06

[52] U.S. Cl. ..... 124/71; 124/73; 124/81; 124/83

[58] Field of Search ..... 124/81, 71, 73, 56, 124/83, 65, 52, 51.1, 48

[56] References Cited

U.S. PATENT DOCUMENTS

| | | | |
|---|---|---|---|
| 1,327,723 | 1/1920 | Midyett . | |
| 2,779,323 | 1/1957 | Thomsen | 124/27 |
| 3,288,127 | 11/1966 | Bullock | 124/81 X |
| 3,855,988 | 12/1974 | Sweeton | 124/56 |
| 3,949,731 | 4/1976 | Caso | 124/27 |
| 4,002,336 | 1/1977 | Beaver et al. | 124/81 X |
| 4,021,037 | 5/1977 | Torbet | 124/56 X |
| 4,207,857 | 6/1980 | Balka, Jr. | 124/56 |
| 4,696,347 | 9/1987 | Stolov et al. | 124/81 X |
| 4,819,609 | 4/1989 | Tippmann | 124/72 |
| 4,936,282 | 6/1990 | Dobbins et al. | 124/74 |

FOREIGN PATENT DOCUMENTS

| | | | |
|---|---|---|---|
| 1185096 | 1/1965 | Fed. Rep. of Germany | 124/56 |

*Primary Examiner*—Randolph A. Reese
*Assistant Examiner*—Harry C. Kim
*Attorney, Agent, or Firm*—Cindrich & Titus

[57] ABSTRACT

An improved barrel for guns which do not have standard internal rifling is disclosed. The barrel has a plurality of apertures which extend a first longitudinal distance along the barrel from the muzzle end toward the breech end. The apertures may define a pair of parallel helixes. The sum of the cross-sectional areas of all apertures in the barrel exceeds the cross-sectional area of the barrel itself. Additionally, each aperture is bored at an angle so that its longitudinal axis defines an acute angle with a plane which is tangent to the barrel and which intersects the aperture. The apertures expel ambient air from the barrel and allow for expansion of compressed gas to stabilize a projectile, such as a paintball, thereby improving the accuracy of the gun. The barrel may also include two-staged honing, as well as a removable choke adjacent the breech end of the barrel.

6 Claims, 2 Drawing Sheets

IMPROVED BARREL FOR PAINTBALL GUN

BACKGROUND OF THE INVENTION

1. Field of the Invention

This invention relates to guns which do not have standard internal rifling and, particularly, to marking guns (commonly called "paintball guns") having various applications including the recreational sport of Paintball (also known as "Capture the Flag" or "Survival").

Paintball is a popular sport played on large outdoor fields. The object of the game is to capture the flag of the opposing team. Players are eliminated when they are struck by a small, rubberized ball containing paint. The ball is designed to rupture and splatter paint on the stricken player. The paintballs are shot by gas-powered paintball guns, which generally resemble elongated pistols. The paintball guns expel the paintballs by releasing gas (typically $CO_2$) under pressure. Paintball guns have other uses, such as marking livestock. A related gun is the tranquilizer gun, which fires treated darts using compressed gas.

2. Description of the Prior Art

To date, inaccuracy has been a major problem for paintball guns. Paintball players have frequently complained that after spending several minutes stalking their opponent for the perfect shot, they took aim, fired and missed. This was especially true when the shots were taken in the wind.

Many unsuccessful attempts have been made in the past to improve the accuracy of paintball guns. Most involved barrel sizing or improving the barrel finish. More particularly, certain attempts have been made to create internal rifling of the paintball gun barrel, similar to rifling in an actual firearm. This generally involves placement of spiralled grooves inside the paintball gun barrel. Again, this attempt to improve accuracy has been unsuccessful because paintballs are not strong enough to withstand standard internal rifling. When the paintball is shot through the barrel, the force of the paintball engaging the grooves causes the paintball to break.

U.S. Pat. Nos. 1,327,723; 2,779,323 and 3,949,731 all disclose the general concept of perforating the barrel of a firearm. None of these references, however, disclose perforations employed as a means to improve accuracy.

U.S. Pat. Nos. 4,819,609 and 4,936,282 disclose gas-powered paintball guns. Neither one of these references teach or suggest perforating the barrel of the paintball gun for any reason.

The general concept of perforating a gun barrel, particularly near the muzzle end, is a well known technique employed for reducing recoil in both hand guns as well as rifles and shotguns. Even military cannons, particularly those used on tanks, include muzzle blast compensators having ventilation openings on the sides of the barrel. However, nothing in the prior art reviewed teaches or suggests perforating the barrel of a firearm for the purpose of improving accuracy.

It is therefore an object of the present invention to stabilize the spin on a paintball for improving the accuracy of the paintball shot. It is a further object to improve long distance accuracy of paintball shots and also to increase the percentage of paintballs which break on impact. It is a still further object of the invention to permit the escape of moisture build-up in the paintball gun barrel and to lower the noise created by the paintball shot.

SUMMARY OF THE INVENTION

Accordingly, I have developed an improved gun barrel which has a breech end and a muzzle end. A plurality of apertures in the barrel extend a first longitudinal distance from the muzzle end toward the breech end. The barrel has a first cross-sectional area at the muzzle end, and a sum total of the cross-sectional areas of all the apertures in the barrel is greater than the first cross-sectional area of the barrel. Additionally, the intersection of a longitudinal axis of each aperture with a plane which is tangent to the barrel and which intersects the aperture may define an acute angle.

The apertures may define a helix and may be spaced a second longitudinal distance from one another. In this embodiment, the apertures are also spaced a first arcuate distance from one another around the circumference of the barrel. The gun barrel may further include a second helix which is parallel with the first helix and which is spaced from the first helix a second arcuate distance traced around the circumference of the barrel by rotation of the radius of the gun barrel through an angle of approximately 180°.

Also, the barrel may be formed so that the projectile is introduced to three distinct stages during the shot. In the first stage, a choke is placed adjacent the breech. This choke can vary from 0.6845 to 0.6875 inch in diameter, the choke to be used being determined by the outside temperature with the smallest choke being used for very cold days and the largest for hot days. The second stage is achieved by honing from the choke to the first aperture closest to the breech to a diameter of 0.690 to 0.692 inch, the traditional industry bore size. The third and final stage, from the first aperture nearest the breech to the end of the muzzle is approximately ten thousandths of an inch larger, i.e., 0.697 to 0.701 inch.

A method for rifling a gun barrel to improve the accuracy of a projectile expelled therethrough is also provided.

Further details and advantages of the present invention will be apparent from the following detailed description, in conjunction with the accompanying drawings.

DETAILED DESCRIPTION OF THE PREFERRED EMBODIMENTS

Figure 1:
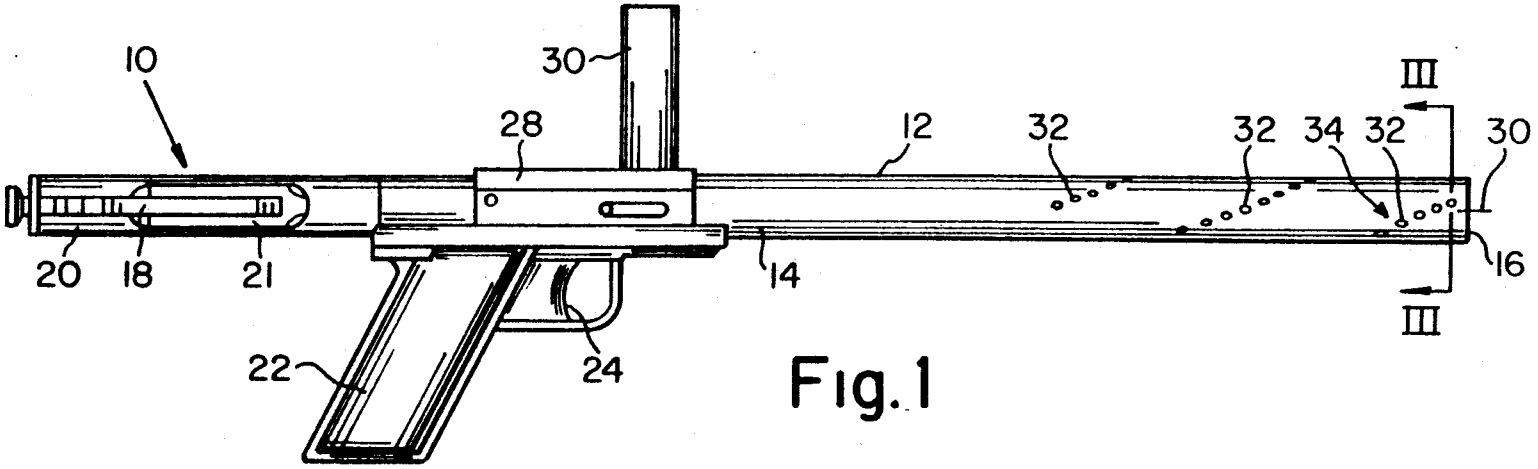
FIG. 1 is a side view of a paintball qun having an improved barrel of the present invention.

FIG. 1 shows a paintball gun 10 which has an improved barrel 12 according to the present invention. The barrel 12 has a breech end 14 and a muzzle end 16.

Typical paintball guns also include a receiver 18 in a butt 20 of the paintball gun 10 for receiving a $CO_2$ cartridge 21 which powers the paintball gun 10. Paintball gun 10 also includes a pistol grip 22 and a trigger 24. Some paintball guns require manual cocking, and thus a pump (not shown) may be present on barrel 12. Semi-automatic and fully automatic paintball guns, such as paintball gun 10, do not require a pump. Semi-automatic guns fire one projectile each time the trigger 24 is squeezed, and fully automatic guns fire a continuous stream of projectiles for as long as the trigger 24 is depressed. A breech 28 is located above trigger 24, and a magazine or ball retainer 30 feeds projectiles into the breech 28 for firing. Further details about paintball guns may be seen from U.S. Pat. No. 4,819,609 to Tippmann entitled "Automatic Feed Marking Pellet Gun" and U.S. Pat. No. 4,936,282 to Dobbins, et al. entitled "Gas Powered Gun".

In developing my invention, I proceeded in the following steps. First, I determined to relieve the air column that precedes the ball during the shot and to relieve the excess $CO_2$ gas following the ball to ease the entry of the ball from the muzzle 16 into the atmosphere. To do this, I tried drilling apertures in various sizes and patterns along the barrel 12.

I found that the patterns which assisted accuracy had certain characteristics, i.e.: (1) the initial aperture should be placed approximately ¼ inch from the muzzle 16 to avoid turbulence from that aperture; (2) the pattern of apertures should extend from the muzzle end 16 towards the breech end 14 a minimum of 3.5 inches and preferably at least 6 inches along the barrel; (3) improvement occurred when the apertures not only extended along the length of the barrel 12 but also if they went around at least a portion of the circumference of the barrel; (4) there needed to be a length of the barrel from the breech towards the muzzle which had no holes for a minimum of 3 inches and preferably 6 inches or more; and (5) it was most important that the area of all the apertures exceeded the area of the front of the muzzle to quickly relieve the air column in front of the ball. In fact, my best results occurred when the combined area of all the apertures exceeded the area of the muzzle opening by approximately three times. I tried various hole sizes and determined that the apertures had to be fairly small and numerous if they were to extend both around the barrel 12 and along the 6 inches of barrel length and were to considerably exceed the area of the muzzle 16 of the barrel. To accomplish this I decided that the apertures should not exceed ¼ inch and should preferably be ⅛ inch. I used 96 such holes. I drilled some 36 patterns using these characteristics and since I did improve accuracy with all these patterns, I do not consider my invention to be limited to one particular pattern.

Second, I tried to achieve greater accuracy by putting modestly controlled spin on the paintball. To achieve this I placed the apertures in a helical pattern described later in this application and found that with two helixes at 180° to each other, my results improved. I further angled all the apertures described hereinafter and found that the helical patterns in combination with the angled apertures caused the expelling jets of air and gas to put a controlled spin on the air and gas columns that in turn influence the paintball. I thus further improved the accuracy and distance of the shot.

Thirdly, I determined that the air column would do its work on the ball if the ball could be gradually introduced to a larger barrel. Thus, at the breech area 28, I developed a series of chokes which expose the ball initially to a tight bore for a very short distance. I found that these chokes concentrated the $CO_2$ behind the paintball and started the paintball moving in a very straight path. If the tight bore is carried too long a distance, it acts as a drag on the paintball and shortens the distance the ball can travel.

In the area of the barrel 12 from the choke to the first aperture, I honed the barrel to a first diameter, and from there to the muzzle 16, I honed to a second diameter larger than the first. These three stages of barrel diameters had a dramatic effect. The first stage centered the paintball and started the ball accurately. The second and third stages provided an air cushion, and the third stage provided the gentle spinning air column which was imparted to the paintball. The net results of these various steps were a startling improvement in the accuracy and distance of the paintball.

In theory, when the paintball is accelerated in a closed atmosphere such as a barrel, it pushes the entrapped air ahead of it thereby creating a pressure field higher than the surrounding atmosphere; the ejection process becomes somewhat similar to a jet exhausting against a flat plate normal to the jet stream; a condition that creates great turbulence at the mouth of the jet in this case the muzzle of the barrel.

On the pressure side of the ball, the pressure field is incrementally reduced as the air is forced out through the apertures, thus reducing the resistance to paintball acceleration and also creating a smaller differential pressure between the ball and the atmosphere with less turbulence prevailing. As previously mentioned, the apertures are drilled at an angle and this combined with the double helix pattern causes the gas column to rotate incrementally along the spiral (Volute Action) resulting in some ball rotation. Any rotation of the ball will cause rotation of the fluid (paint) inside the ball thus bringing the center of gravity more in line with the ball's central axis, a condition which would reduce wobbling. Also when the ball enters the atmosphere with some rotation a more quiescent entry occurs.

The $CO_2$ which follows the paintball expands rapidly. If not relieved, this expanding gas can cause a stalling and a turbulence as it follows the ball. The apertures relieve this excess $CO_2$ gas and at the same time the expelled gas contributes to the spinning as it exits through the angled apertures.

The pressure field can be reduced more rapidly when the combined area of all the apertures is greater than the barrel muzzle area.

Finally, the three stage barrel makes a definite contribution to barrel accuracy. The choke (the most narrow stage) concentrates the $CO_2$ behind the paintball and centers the paintball for its passage down the barrel. The second two stages provide cushions of rotating air that impart the controlled spin as the ball proceeds past the apertures.

Observed shots in the field and in the test range have shown great improvement in accuracy, consistency and distance of almost every make of paintball gun presently manufactured when the aforementioned changes are made to the barrel 12 of each gun 10.

Figure 2:
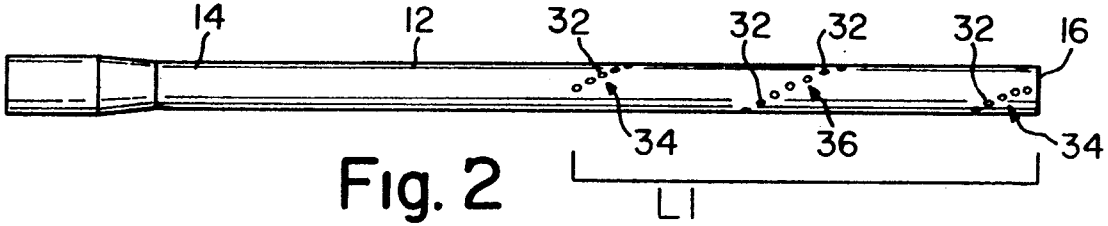
FIG. 2 is a side view of the barrel of FIG. 1.
Figure 5:
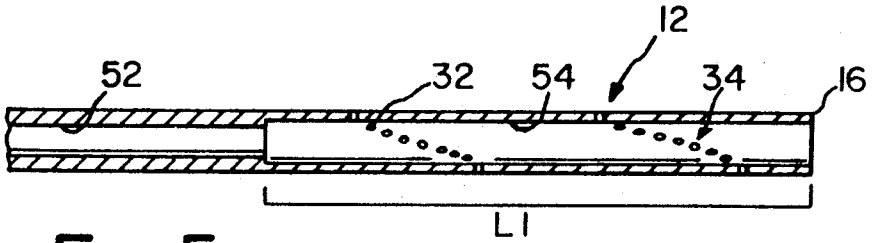
FIG. 5 is a cross-section of a second embodiment of the invention.
Figure 6:
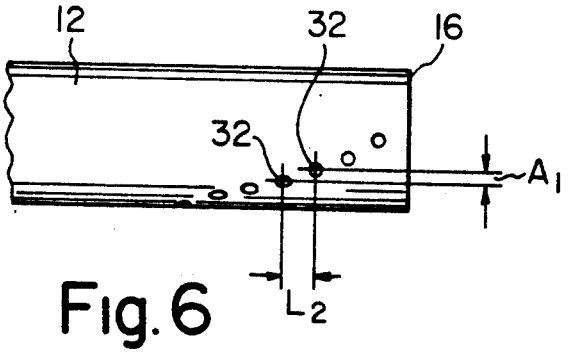
FIG. 6 is an enlarged side view of the front portion of the barrel of FIG. 1.

Referring to FIG. 2, the barrel 12 is shown in isolation. Barrel 12 has a plurality of apertures 32 which define a first helix 34 and a second helix 36 in the front portion of the barrel 12. Specifically, the first and second helixes extend from the muzzle end 16 toward the breech end 14 along the barrel 12 for a first longitudinal distance $L_1$. As shown in FIG. 6, the apertures 32 are spaced a second longitudinal distance $L_2$ from one another. Additionally, each aperture 32 is further spaced a first arcuate distance $A_1$ from its adjacent aperture around the circumference of the barrel 12. Both $L_2$ and $A_1$ are measured between the axial points of the two apertures 32. The first arcuate distance $A_1$ is traced along the circumference of the barrel 12 by rotation of the radius 33 of the barrel through an angle of approximately 7.5°. Each helix 34, 36 preferably comprises 48 apertures 32. Note that in FIGS. 1-8, several of the apertures 32 have been eliminated for clarity.

The first helix 34 and the second helix 36 are parallel and are spaced apart a second arcuate distance $A_2$ around the circumference of the barrel 12. As shown in FIG. 5, the second arcuate distance is traced by rotation of the radius 33 of the barrel 12 through an angle of approximately 180°. Each helix 34, 36 therefore has a helical axis which is concentric with the longitudinal axis 38 of barrel 12. Preferably, each helix 34, 36 completes one period over the first longitudinal distance $L_1$ on the front portion of barrel 12.

Figure 3:
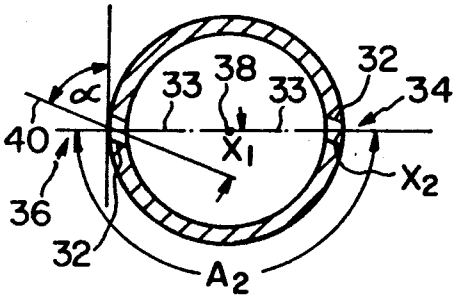
FIG. 3 is a cross-section taken along lines III—III of FIG 1.

Referring to FIG. 3 the barrel 12 has a first cross-sectional area $X_1$ at the muzzle end 16. Each aperture 32 has a second cross-sectional area $X_2$. The significance of the relationship between these two areas will be discussed in further detail below. The intersection of a longitudinal axis 40 of each aperture 32 with a plane 42 which is tangent to the barrel 12 and which intersects the aperture 32 defines an acute angle. Thus, the apertures 32 are preferably not drilled at a normal to the longitudinal axis 38 of barrel 12. This is believed to enhance the effect of the apertures 32 in improving accuracy by imparting rotative action to the projectile expelled through the barrel 12.

The preferred dimensions for the improved paintball gun barrel 12 are as follows:

$L_1$=approximately 3.5 inches to approximately 7 inches;

$L_2$=approximately 0.130 inch;

$A_1$ is traced by rotation of radius 33 through an angle of approximately 7.5°;

$A_2$ is traced by rotation of radius 33 through an angle of approximately 180°;

Diameter of apertures 32=⅛ inch, and in no case greater than ¼ inch.

Figure 7:
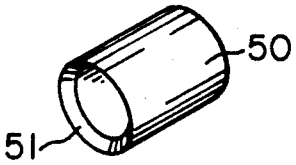
FIG. 7 is a perspective view of a choke.
Figure 8:
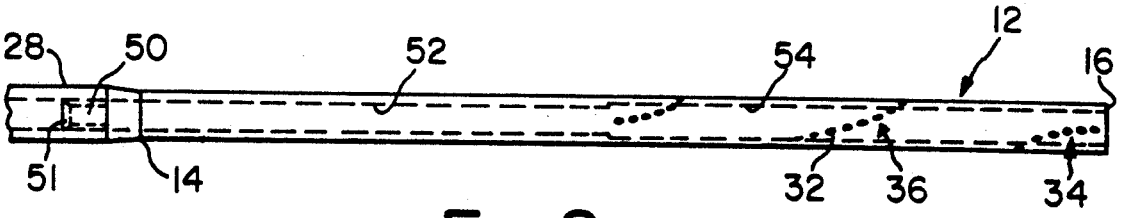
FIG. 8 is a side view of a third embodiment of the invention.

Referring to FIGS. 5, 7 and 8, the barrel may be developed in three stages. First, a removable choke 50, approximately ½ inch in length and approximately 0.6845 to 0.6875 inch in diameter is placed just after the breech 28. Using several chokes alternately, the initial diameter to which the ball 44 is exposed can be varied to accommodate differences in outside temperature, with the most narrow choke being used for the coldest days and the widest choke for very hot days. In all cases the chokes 50 are narrower than the rest of the barrel 12 in order to concentrate the $CO_2$ behind the ball and to center the ball in its initial passage. The choke 50 is kept very short in length (less than 4 inches) to prevent drag. The choke 50 has an inward chamfer or bevel 51 on the end of the choke opposite the barrel. This facilitates entry of paintball 44 into the narrow choke 50 from breech 28. A second stage 52 goes from the choke 50 to the nearest aperture 32 and is honed to a larger diameter (approximately 0.690 to 0.692) than the choke.

A third stage 54 extends from the nearest aperture 32 after the breech 28 to the muzzle 16 and is approximately ten thousandths of an inch larger than the second stage 52 (approximately 0.697 to 0.702). Thus, the third stage extends the first longitudinal distance $L_1$ from the muzzle 16 toward the breech 14, coextensive with the apertures 32. The second and third stages provide an increasing column of spinning air to cushion the ball as it travels out of the barrel 12 towards the target.

Thus, at the breech area, I developed a series of chokes 50 less than 3 inches and preferably ½ inch in length in diameters of 0.6845 to 0.6875. These chokes introduce the ball initially to a tight bore for a very short distance. I found that these chokes concentrated the $CO_2$ behind the ball and got the ball started in a very straight path. If the tight bore is carried too long a distance, it acts as a drag on the ball and hurts the distance the ball can travel. Thus, the choke should not exceed 4 inches. The reason for a series of chokes is that the balls not only vary in size from different manufacturers, but also increase in diameter in hot temperatures and decrease in cold temperatures so that different tight bore diameters are needed to prevent breakage in more extreme temperatures.

These three stages of barrel diameters have a dramatic effect. The choke 50 centers the ball and starts the ball accurately. The second and third stages 52, 54 provide an air cushion, and the third stage 54 provides the gentle spinning air column which is imparted to the ball.

The invention also includes a method for rifling the barrel 12 to improve the accuracy of a projectile which i expelled through the barrel from the breech end 14 outward through the muzzle end 16. Initially, a first aperture 32 is bored in barrel 12 adjacent to the muzzle end 16. Preferably, the first aperture is drilled ¼ inch from the end of the barrel 12. The barrel 12 is then rotated about its longitudinal axis 38 in a first direction through a first angle equal to about 7.5°, measured from the first aperture 32. A succeeding aperture 32 is then bored in the barrel 12 the second longitudinal distance $L_2$, preferably 0.130 inch, toward the breech end 14 from the adjacent aperture 32. After boring, the barrel 12 is again rotated about its longitudinal axis 38 in the first direction through the first angle measured from the aperture bored in the previous step.

The last two steps are then repeated until a first helix 34 is defined by the apertures 32 in the barrel 12. The first helix 34 has a helical axis concentric with the longitudinal axis 38 of the barrel, and the first helix extends the first longitudinal distance $L_1$ from the muzzle end 16 toward the breech end 14. All of the steps are repeated to define the second helix 36 in the barrel 12, with the second helix 36 parallel to the first helix 34 and spaced 180° around the circumference of the barrel 12. Additionally, the apertures may be bored so that their longitudinal axes 4 define acute angle at their point of intersection with the plane 42, which is tangent to the barrel 12 and which intersects the aperture 32. The number and size of the apertures 32 bored in the barrel 12 are drilled so that the sum total of the cross-sectional areas $X_2$ of all of the apertures 32 in the barrel 12 is greater than the cross-sectional area $X_1$ of the barrel 12 at its muzzle end 16.

The apertures 32 allow the air in front of the paintball 44 and the excess $CO_2$ behind the paintball to escape. The helical pattern and angled orientation of the apertures is believed to cause the air surrounding the ball to spin, and this spin is translated to the paintball to impart a modest rotation on the paintball. The three stage barrel shown in FIG. 6 was found to greatly improve the accuracy and range of the paintball and increases the percentage of paintballs which break on contact with the target. The apertures 32 in the barrel 12 also prevent moisture build-up inside the barrel, and reduce the noise created by the shot.

The present invention thus provides a rifling device such as that found in conventional firearms, without the need for placement of grooves inside the barrel 12. As stated, the grooves would cause destruction of the paintballs 44 when they are expelled through the barrel 12. To confirm the rifling effect of the present invention, certain tests were conducted, the results of which are summarized in the following two examples.

EXAMPLE I

To determine the effect of the apertures 32 on the column of air in the barrel 12, a plenum chamber was built around the barrel 12 and connected to a static pressure gauge. The barrel 12 had 96 apertures 32 therein, with the apertures defining two parallel helixes 34, 36, each helix extending 6 inches from the muzzle end 16 of the barrel toward the breech end 14. The apertures were ⅛ inch in diameter.

When the first test shot was fired, it was determined that the plenum chamber had been pressurized, meaning that the air column in front of the paintball was escaping from the apertures 32 during the shot.

EXAMPLE II

Figure 4:
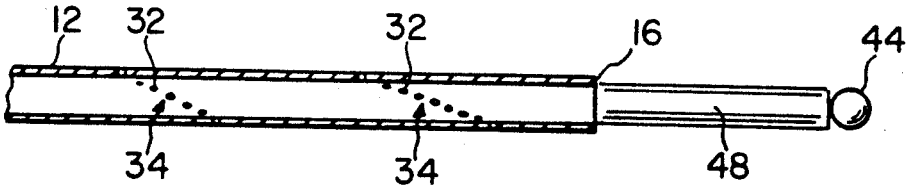
FIG. 4 is a cross-section of the barrel of FIG. 2, displaying the effects of the present invention on a paintball expelled through the barrel.

High speed stroboscopic photographs were taken of a paintball 44 being fired first from an undrilled barrel and second from a barrel drilled in accordance with the present invention. FIG. 4 illustrates these photographs.

As observed, there was little or no gas following the paintball 44 through the undrilled barrel. The only gas seen escaped in a wisp from the muzzle end 16 of the barrel 12. Conversely, FIG. 4 demonstrates how the gas escaped from the barrel 12 drilled according to the present invention. A column 48 of gas was seen following the paintball 44 for a significant distance beyond the muzzle end 16 of barrel 12. The apertures 32 permit the air in barrel 12 that precedes the paintball 44 to escape, while also permitting expansion of gas behind the paintball. The expanding gas follows the ball out of the barrel. The column 48 stabilizes the paintball 44 and aids in keeping the paintball in a direct flight path toward the target.

Having described the presently preferred embodiments, it will be understood that the invention may be otherwise embodied within the scope of the following claims.

I claim:

1. A gun barrel having a length and comprising:

a breech end;

a muzzle end having a first cross-sectional area; and a plurality of apertures defined in said gun barrel, said apertures extending along said gun barrel proximately from said muzzle end toward said breech end a first longitudinal distance less than the length of said gun barrel, and further extending around at least a portion of a circumstance of said gun barrel;

wherein a sum total of the cross-sectional areas of all the apertures in said gun barrel exceeds said first cross-sectional area; and said apertures expel air in the gun barrel from in front of a projectile and expel gas from the rear of the projectile to reduce turbulence and improve the accuracy and distance of the projectile when shot from said breech and outward through said muzzle end.

2. The gun barrel of claim 1 wherein an intersection of a longitudinal axis of each aperture with a plane which is tangent to said gun barrel and which intersects said aperture defines an acute angle.

3. The gun barrel of claim 1 wherein an inside of said barrel is honed in two stages, a first stage extending the first longitudinal distance from said muzzle end toward said breech end, and a second stage extending from said first stage to said breech end, said second stage more narrow than said first stage.

4. A gun barrel having a length comprising:

a breech end;

a muzzle end having a first cross-sectional area; and a plurality of apertures defining a pair of parallel helixes in said gun barrel;

wherein said helixes extend along said gun barrel proximately from said muzzle end toward said breech end a first longitudinal distance less than the length of said gun barrel;

said helixes include a helical axis concentric with the longitudinal axis of said gun barrel;

said apertures are spaced a second longitudinal distance from one another;

each aperture is further spaced a first arcuate distance from its adjacent around the circumference of said gun barrel; and a sum total of the cross-sectional areas of all the apertures in said gun barrel exceeds said first cross-sectional area.

5. The gun barrel of claim 4 wherein an intersection of a longitudinal axis of each aperture with a plane which is tangent to said gun barrel and which intersects said aperture defines an acute angle.

6. In a paintball gun having a breech and a barrel with a muzzle end and a breech end, the improvement comprising:

said gun barrel having a length and a first cross-sectional area at said muzzle end;

a plurality of apertures defined in said gun barrel, said apertures extending along said gun barrel proximately from said muzzle end toward said breech end a first longitudinal distance less than the length of said gun barrel, and further extending around at least a portion of a circumference of said gun barrel;

wherein a sum total of cross-sectional areas of all the apertures in said gun barrel exceeds said first cross-sectional area;

said apertures expel air in said gun barrel from in front of a projectile and expel gas from the rear of the projectile to reduce turbulence and improve the accuracy and distance of the projectile when shot from said breech end outward through said muzzle end; and a choke in said breech adjacent the breech end of said gun barrel, said choke having an inward chamfer on an end of the choke opposite said gun barrel.

* * * * *